US010351401B2

(12) United States Patent
Pisarik

(10) Patent No.: US 10,351,401 B2
(45) Date of Patent: Jul. 16, 2019

(54) WORK IMPLEMENT FRAME WITH GATE

(71) Applicant: Paladin Brands Group, Inc., Oak Brook, IL (US)

(72) Inventor: Ronald James Pisarik, Mount Vernon, IA (US)

(73) Assignee: Paladin Attachments, Dexter, MI (US)

( * ) Notice: Subject to any disclaimer, the term of this patent is extended or adjusted under 35 U.S.C. 154(b) by 0 days.

(21) Appl. No.: 15/611,438

(22) Filed: Jun. 1, 2017

(65) Prior Publication Data

US 2017/0349417 A1 Dec. 7, 2017

Related U.S. Application Data

(60) Provisional application No. 62/344,639, filed on Jun. 2, 2016.

(51) Int. Cl.

| | |
|---|---|
| ***B66F 9/075*** | (2006.01) |
| ***B66F 9/12*** | (2006.01) |
| *B66F 9/065* | (2006.01) |

(52) U.S. Cl.

CPC ..... *B66F 9/075* (2013.01); *B66F 9/12* (2013.01); *B66F 9/065* (2013.01)

(58) Field of Classification Search

CPC combination set(s) only.

See application file for complete search history.

(56) References Cited

U.S. PATENT DOCUMENTS

| | | | | | |
|---|---|---|---|---|---|
| 1,615,753 | A * | 1/1927 | Gilowitz | A62B 1/02 | 182/141 |
| 3,493,078 | A * | 2/1970 | Colley | B66F 9/127 | 182/113 |
| 4,002,147 | A * | 1/1977 | Feterl | A01D 87/122 | 119/60 |
| 4,073,382 | A * | 2/1978 | Fahey | B65G 1/026 | 187/239 |
| 4,497,606 | A * | 2/1985 | Hobson | B66F 9/12 | 414/607 |
| 4,688,981 | A * | 8/1987 | Ravnsborg | B66F 9/12 | 414/607 |
| 6,047,791 | A * | 4/2000 | Hoebelheinrich | B66F 9/0655 | 187/222 |
| 8,066,320 | B1 * | 11/2011 | Grabowski | E05F 1/1223 | 16/334 |
| 8,556,330 | B2 * | 10/2013 | Lazarevich | E05D 7/1005 | 16/262 |

(Continued)

FOREIGN PATENT DOCUMENTS

| | | |
|---|---|---|
| EP | 1197367 | 4/2002 |
| EP | 1686015 | 12/2009 |

*Primary Examiner* — Michael A Riegelman

(74) *Attorney, Agent, or Firm* — Nyemaster Goode, PC

(57) ABSTRACT

A work implement frame having a top support and a bottom support. The top support and bottom support are tied together structurally by end plates and/or vertical ribs. One or more fork tines may be combined with the top or bottom support of the frame and are adapted to carry pallets or other loads as is know in the art. The frame includes a load rest to help support the load. The load rest is typically positioned near the top of the frame. A gate in the load rest is movable between an open position and a closed position. In its open position an operator may pass through the gate to enter the cab. The gate may be pivotally or slidably combined with the load rest.

21 Claims, 5 Drawing Sheets

(56) References Cited

U.S. PATENT DOCUMENTS

| | | | | |
|---|---|---|---|---|
| 2009/0139803 | A1* | 6/2009 | Smeeton | B66F 9/07504 187/408 |
| 2013/0112506 | A1* | 5/2013 | Zuercher | B66B 9/04 187/200 |
| 2014/0318901 | A1* | 10/2014 | Philipopoulos | B66F 9/12 187/222 |
| 2016/0090286 | A1* | 3/2016 | Belotti | B66F 9/165 414/607 |

* cited by examiner

WORK IMPLEMENT FRAME WITH GATE

This application is based upon U.S. Provisional Application Ser. No. 62/344,639 filed Jun. 2, 2016, the complete disclosure of which is hereby expressly incorporated by this reference.

BACKGROUND

The present invention relates to a work implement frame which may be a pallet fork frame. More specifically, the invention relates to work implement frame having a selectively openable gate in the load rest.

Lift trucks such as forklifts or skid-steer vehicles are common machines for moving heavy loads. They are often used in a warehouse or other industrial setting in which speed and efficiency are required for moving heavy objects. These lift trucks typically include an elongated chassis supported by two sets of wheels. In the case of a skid steer loader, the engine compartment is adjacent the rear end of the chassis and the operator's compartment is adjacent the front end. The chassis includes a pair of stanchions or uprights positioned adjacent the opposite sides of the engine compartment and extending upwardly therefrom. A pair of lift arms is pivotally connected at one end about a common pivot axis on the respective uprights. The arms extend generally forwardly along opposite sides of the chassis in close proximity to the operator's compartment and terminate at a work implement at the front of the chassis and ahead of the front set of wheels.

The arms of the skid-steer may be combined with various work implement attachments. One work implement attachment is a pallet fork, which includes a frame combined with one or more forks for picking up and placing objects such as pallets. The frame serves several functions. One function of the pallet fork frame is to help support the forks and the load carried on the forks. Another function of the frame is to provide a vertical surface against which the load may rest and be stabilized. A load rest is a guard which traditionally extends across the entire width of the frame. One problem with traditional pallet fork frames is that they are often positioned directly in front of the cab thereby making it difficult for the operator to enter and exit the cab. Typically operators are required to enter the cab from the side by stepping up on the side of the frame then climbing between the frame and the cab. In normal operation the operator may tilt the pallet fork attachment backward (toward the cab) while the load is being transported to help secure the load and prevent it from falling off the front of the pallet fork. The frame is positioned between the load and the operator. Thus, another function of the frame/load rest is to help protect the operator from material that may otherwise fall from the load toward the cab.

There is therefore a need for an improved work implement frame which allows easier access to and from the cab while also securing the load and protecting the operator from material that may fall from the load.

SUMMARY

One aspect of the invention includes a work implement frame having a top support and a bottom support. The top support and bottom support are tied together structurally by end plates and/or vertical ribs. The work implement frame may be a pallet fork frame having one or more fork tines combined with the top or bottom support of the frame and are adapted to carry pallets or other loads as is known in the art. The frame also has a load rest to help support the load. The load rest is typically positioned near the top of the frame. A gate in the load rest is movable between an open position and a closed position. In one embodiment the gate is pivotably combined with the load rest using hinges. In another embodiment the gate is slidably combined with the load rest so that it moves between open and closed positions by sliding along a track.

Another aspect of the invention includes a method of using the work implement fork frame device described above. An operator desiring to enter the cab of a lift truck vehicle having the implement frame mounted as the attachment opens the gate in the load rest. The operator then walks through the gate, stepping on the step, and enters the cab. The gate is biased in its closed position so it closes after the operator releases it and enters the cab. To exit the cab the operator similarly opens the gate and walks through the load rest stepping on the step. The biasing force closes the gate behind the operator as the operator releases the gate.

DETAILED DESCRIPTION

Figure 1:
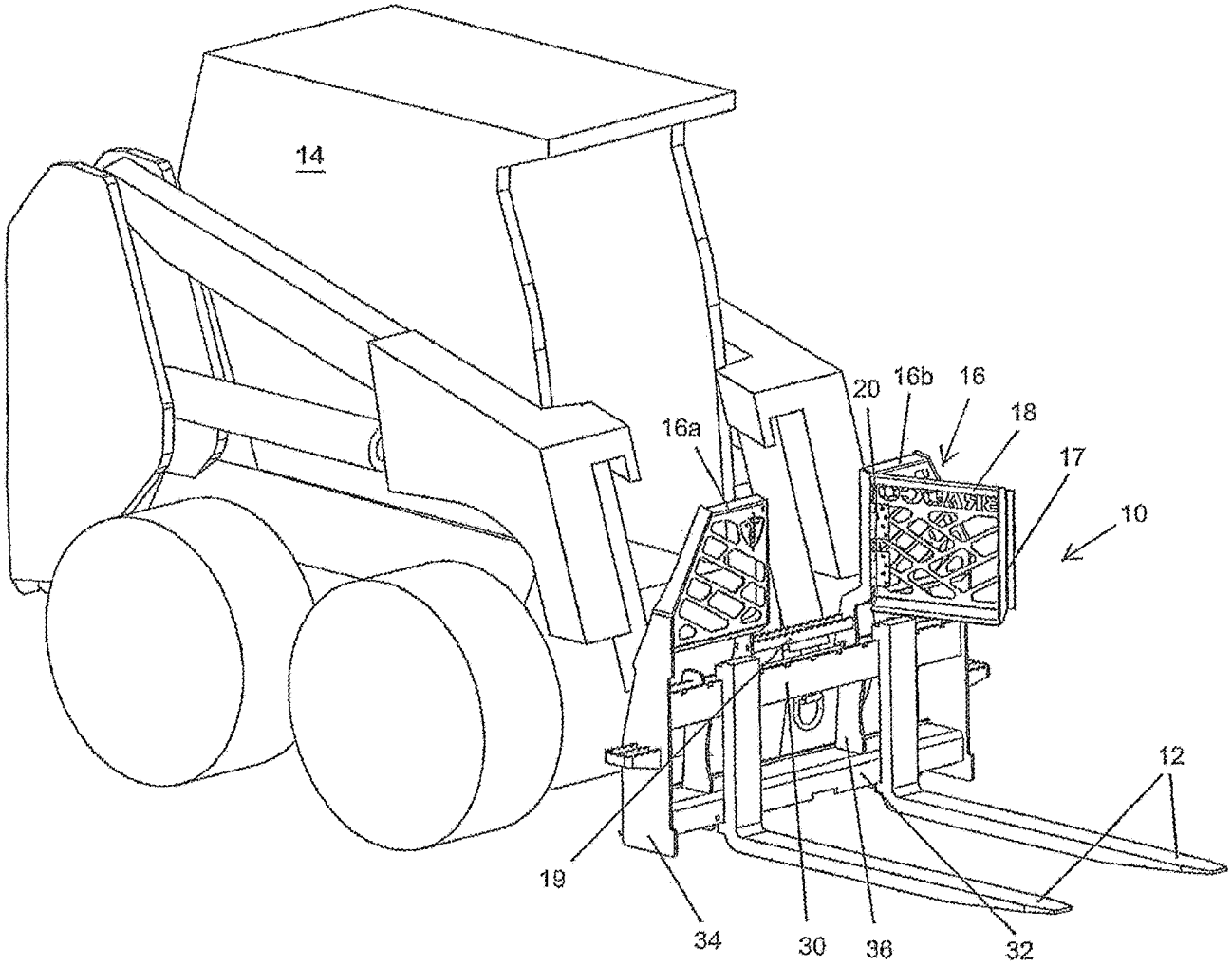
FIG. 1 is a perspective view of an embodiment having a swing gate in an open position showing the implement combined with a lift truck vehicle.
Figure 2:
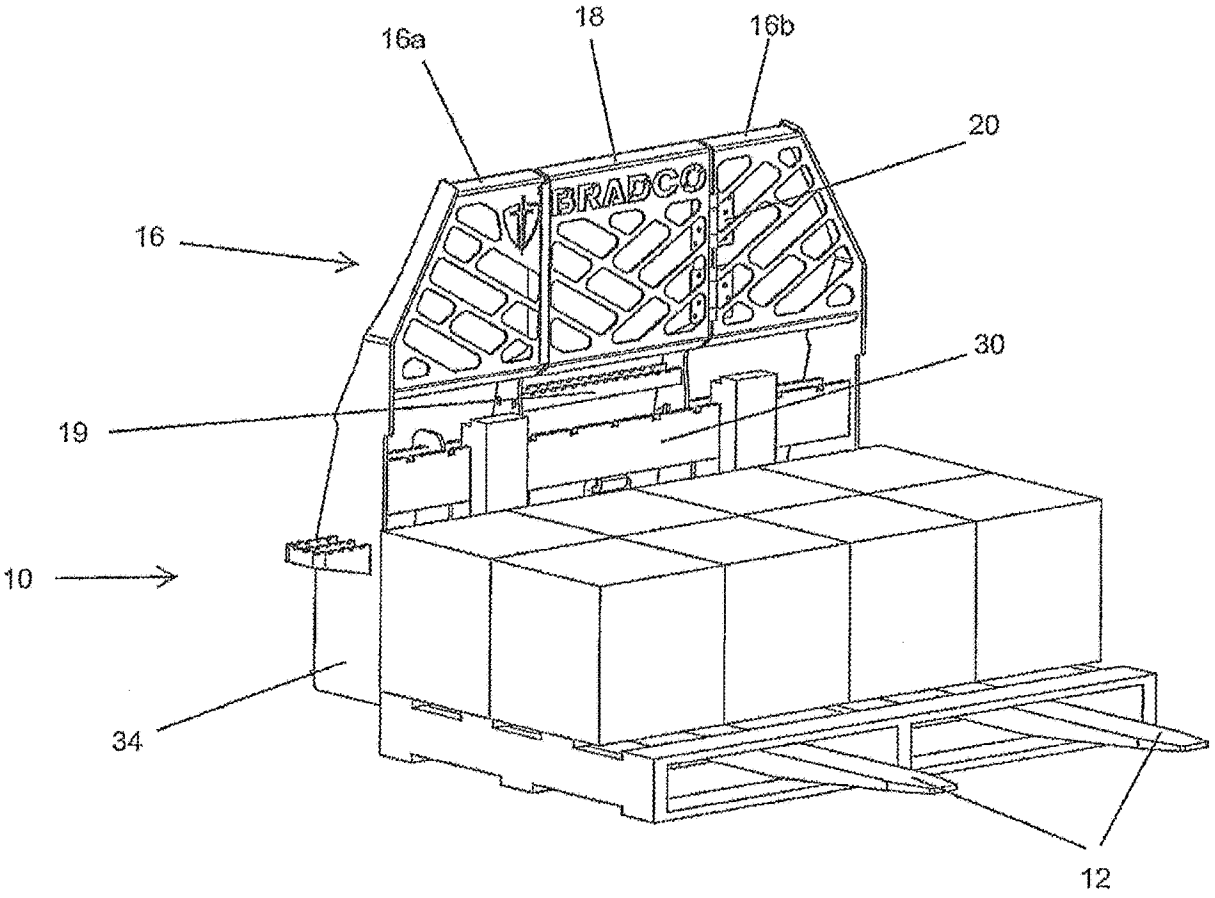
FIG. 2 is a perspective view of an embodiment having a swing gate in a closed position showing the implement carrying a load.

The work implement has a structural frame 10 as shown generally in FIGS. 1-2. FIG. 1 shows the structural frame 10 combined with a lift truck vehicle 14. The structural frame 10 could take many different forms as will be recognized by those of ordinary skill in this art. In the pictured embodiment the structural frame 10 comprises a top support member 30 and a bottom support member 32. The top support 30 and the bottom support 32 together are the individual "backbone" structural members of the implement and are approximately parallel to one another in one embodiment. The top support 30 and bottom support 32 are secured together structurally by end plates 34 and/or vertical ribs 36. One exemplary work implement is a pallet fork having one or more fork tines 12 combined with the top 30 or bottom support 32 of the frame 10 to carry pallets or other loads as is known in the art. For convenience, the invention will be shown and described primarily with reference to a frame 10 adapted to be combined with one or more fork tines 12 extending outwardly therefrom, however, the invention also includes other embodiments wherein the frame 10 is combined with other suitable implements such as hitches, buckets, and hay bale spikes instead of fork tines 12.

The frame 10 is combined with a load rest 16 to help strengthen the frame 10 and support the load. The load rest 16 is usually positioned near the top of the frame 10. The load rest 16 typically extends upward in a generally vertical plane to function like a wall to help support the load. In the embodiment shown, the load rest 16 includes a first portion 16*a* on one side and a second portion 16*b* on another side. A gate 18 is positioned between the first and second portions 16*a*, 16*b*. The gate 18 is movable between an open position (FIG. 1) and a closed position (FIG. 2). In its open position the gate 18 provides easy ingress and egress through the frame 10 as the operator enters and exits the cab. The operator can effectively walk through a portion of the frame 10 instead of having to climb over the frame 10 or enter from the side (between the frame 10 and the cab). In its closed position the gate 18 functions as part of the load rest 16 to help secure the load.

In the embodiment shown in FIGS. 1-2, the gate 18 is pivotally combined with the load rest 16 using one or more hinges 20. In alternate embodiments the gate 18 may be pivotally combined with one or more other parts of the frame 10. One portion of the hinge 20 is combined with the stationary portion of the load rest 16*a* or 16*b* and another portion of the hinge 20 is combined with the gate 18. In this manner, the hinges 20 allow the gate 18 to generally align with the load rest 16 in the closed position and pivot open to create a walkway through the load rest 16 in the open position. In one embodiment the gate 18 pivots outwardly away from the cab to prevent the gate 18 from interfering with the cab. One or more biasing members such as springs may be used to bias the gate 18 in its closed position so that the gate 18 automatically closes behind the operator after the operator climbs through the gate 18 and enters the lift truck vehicle. The biasing members also help the gate 18 stay in its closed position until manually opened by the operator. The biasing members may be part of the hinges 20 (e.g., a spring hinge) or the biasing members may be independent members combined at one end with the stationary portion of the load rest 16*a* or 16*b* and at another end with the movable gate 18. The gate 18 or the load rest 16 may include a gate stop member 17 which prevents the gate 18 from swinging past the proper closed position. The gate stop member 17 is a surface on the gate 18 adapted to engage a surface on the load rest 16 when the springs have pushed the gate 18 to its proper closed position.

One embodiment includes a locking/latching mechanism such as a bolt, snap, or button which helps secure the gate 18 in its closed position. The locking/latching mechanism requires manual actuation in order to move the gate 18 from its closed position to its open position. This alternate embodiment may be used with or without the biasing spring described above.

As shown best in FIG. 1, a step 19 may be combined with the frame 10 below the gate 18. The step 19 provides a generally horizontal surface for the operator to place his/her foot as he/she steps through the gate 18. The step 19 may include a gripping surface to help prevent the operator's foot from slipping. The step 19 may be a generally horizontal member separate from the top support 30 and bottom support 32. The step 19 may be positioned above the top support 30 and below the gate 18. In one embodiment the step 19 is combined with one or more vertical rib members 36.

In the embodiment shown in FIGS. 1-2, the selectively openable gate 18 is positioned generally in the middle of the load rest 16. In other words, it is positioned between the first portion 16*a* and second portion 16*b* of the load rest 16. In alternate embodiments, however, the gate 18 may be positioned on one of the ends of the load rest 16 (so it switches places with one of either the first portion 16*a* or the second portion 16*b* of the load rest 16) instead of in the middle.

Figure 3:
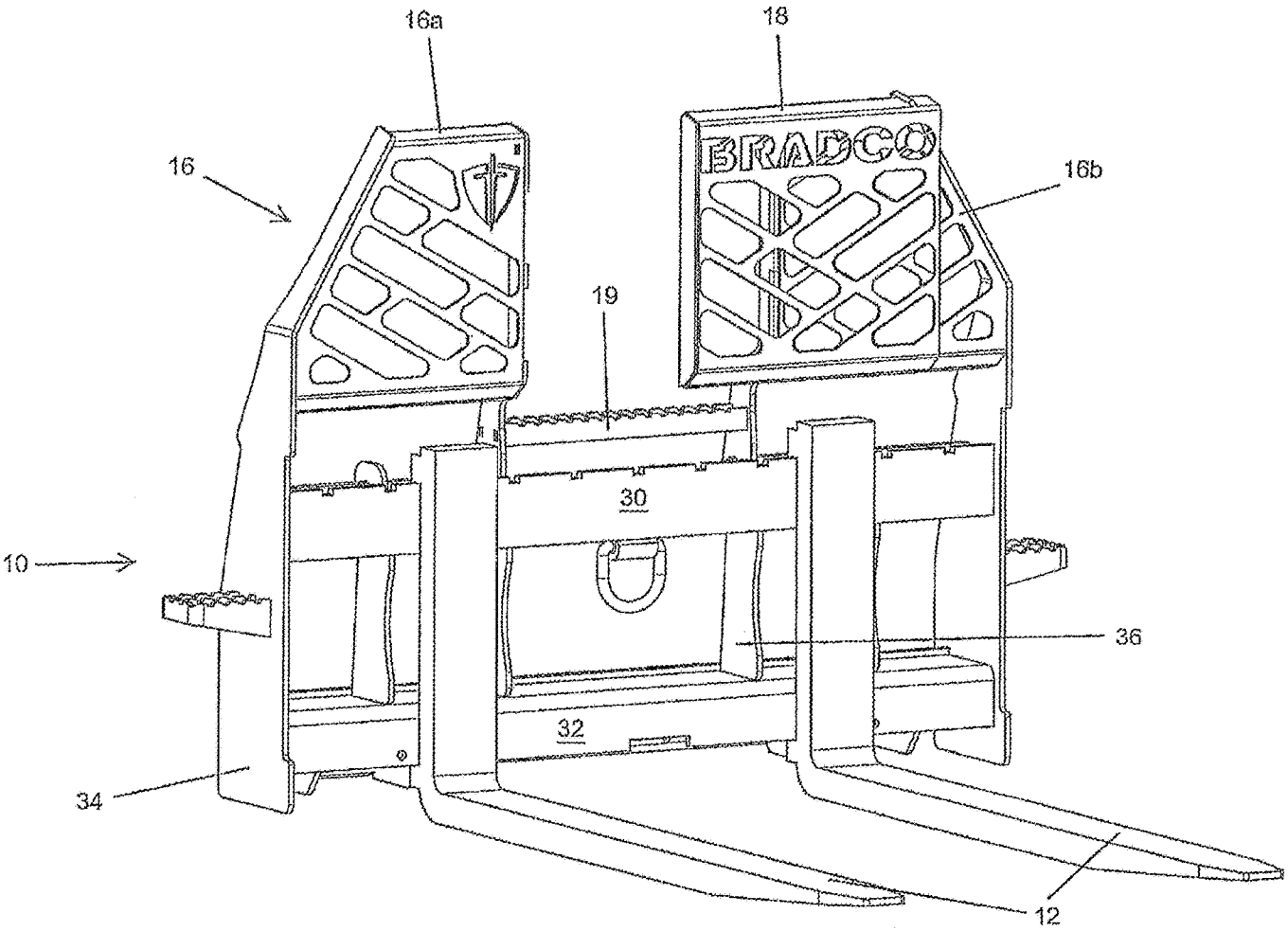
FIG. 3 is a perspective view of an embodiment having a slide gate in an open position.
Figure 4:
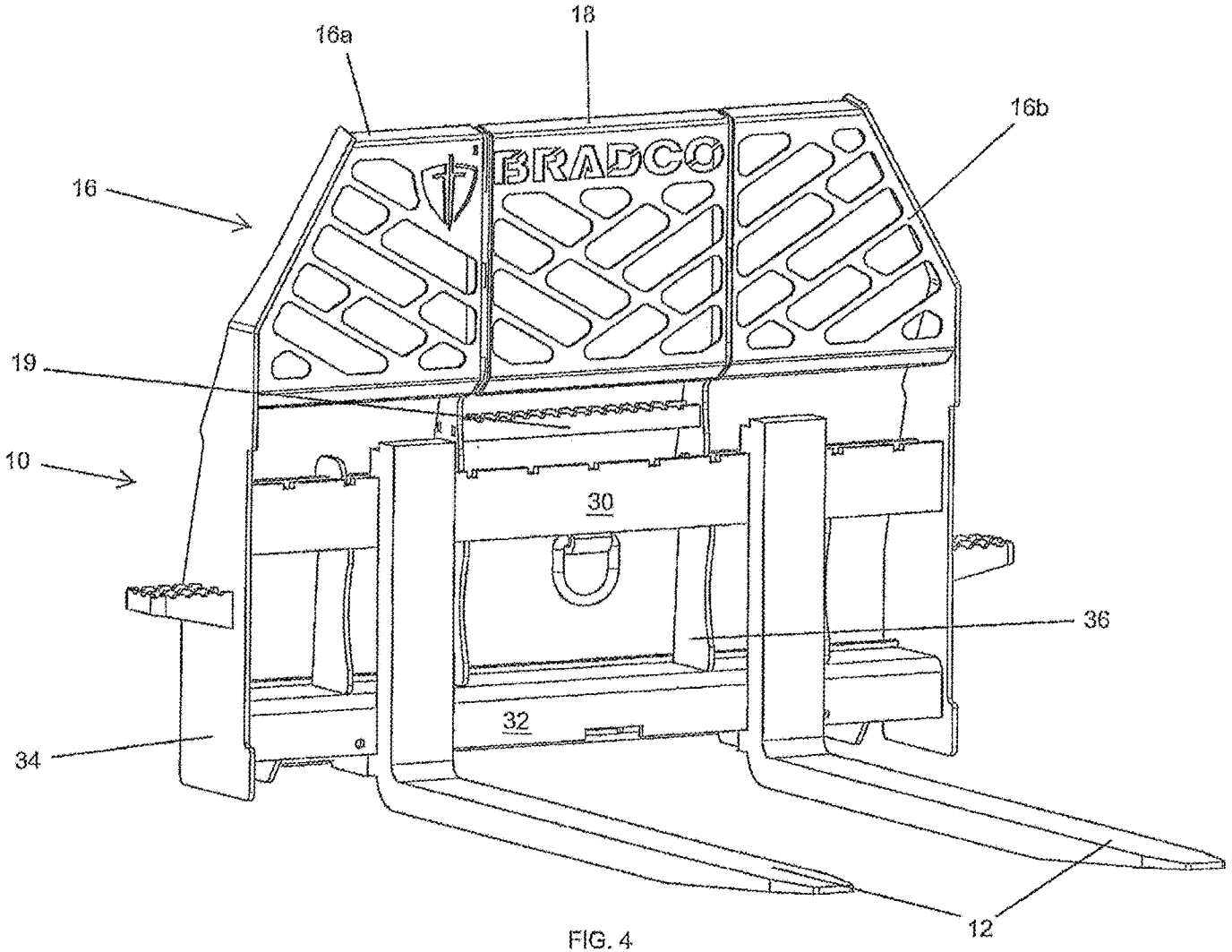
FIG. 4 is a perspective view of an embodiment having a slide gate in a closed position.
Figure 5:
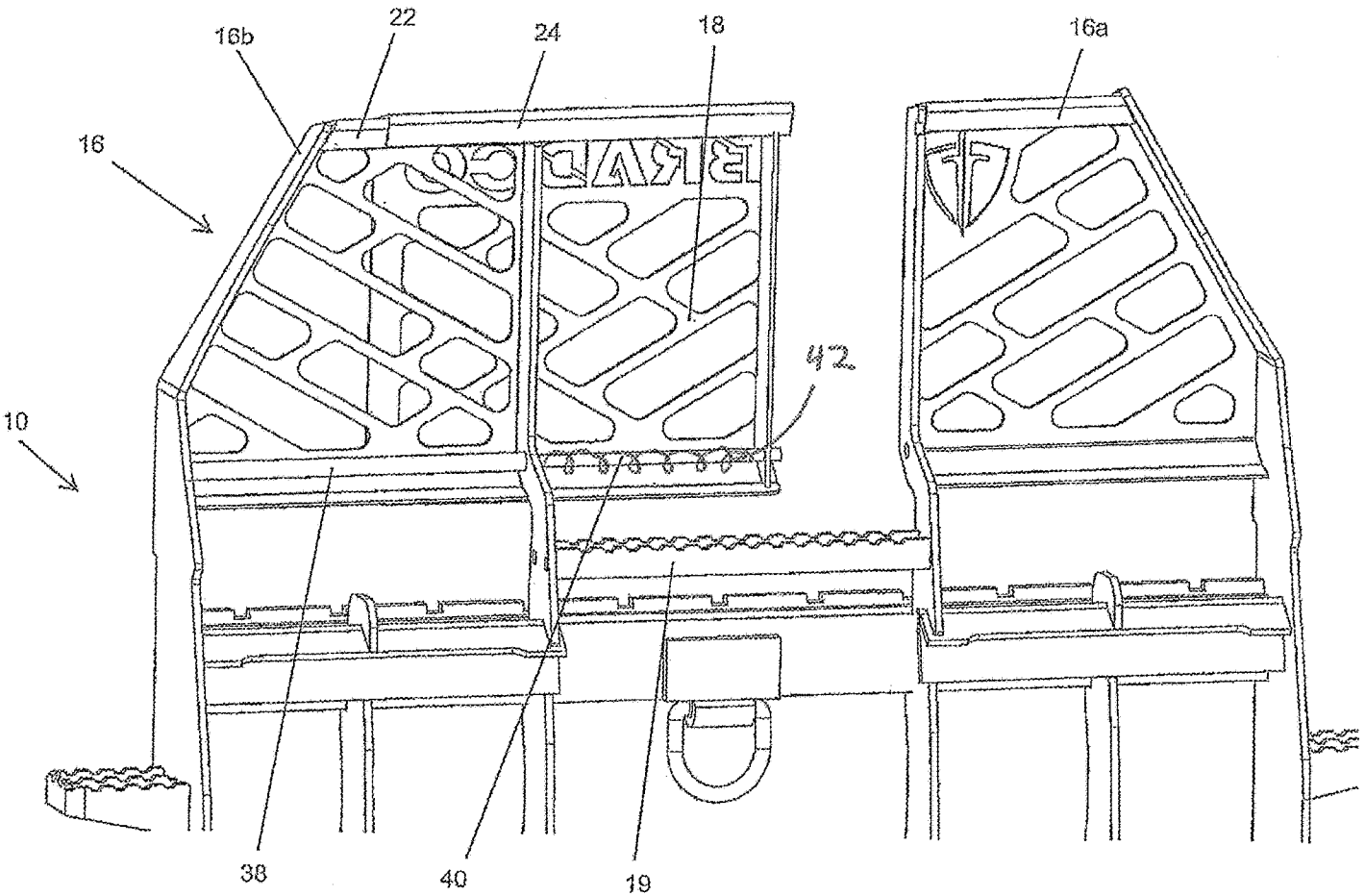
FIG. 5 is a rear view of an embodiment having a slide gate showing the slide mechanism.

FIGS. 3-5 show another embodiment which may include the same features as the ones described above. In this alternate embodiment, however, the gate 18 is slidably attached to the load rest 16 so that it moves between open and closed positions by sliding along a track or rail 22. As shown in FIG. 5, the track 22 may be part of the load rest 16. A rail guide 24, which may be part of the gate 18, engages the rail 22 and guides the gate 18 along the rail 22 between its open and closed position. One or both of the rail 22 and the rail guide 24 may have wheels or bearings to help reduce friction as the gate 18 is being moved. In alternate embodiments the gate 18 may be slidably combined with one or more other parts of the frame 10 such as a tube 38 and a rod 40 (FIG. 5). A biasing member 42 such as a spring may be used to bias the gate 18 in its closed position so that the gate 18 automatically closes behind the operator after the operator climbs through the gate 18 and enters the lift truck vehicle. As shown in FIG. 5, a spring biasing member 42 is combined with the outer portion of the rod 40. The spring 42 has a diameter larger than the tube 38 so that the spring 42 is compressed against an outer surface near the tube 38 as the gate 18 is opened. Releasing the gate 18 allows the spring 42 to return to its extended position as it pushes the gate 18 to its closed position.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims.

What is claimed is as follows:

1. A work implement adapted to carry a load and be moved by an operator, said work implement comprising:

a pallet fork frame;

a load rest combined with the pallet fork frame;

wherein the load rest has a gate movable between an open position having a walkway therethrough and a closed position, wherein the gate is adapted to be positioned between the load and the operator.

2. The work implement of claim 1 wherein the gate is pivotally combined with the load rest.

3. The work implement of claim 2 wherein the pivotal connection includes a hinge having a first portion combined with the load rest and a second portion combined with the gate.

4. The work implement of claim 1 wherein the gate is slidably combined with the load rest.

5. The work implement of claim 1 wherein the pallet fork frame further comprises a step positioned beneath the gate.

6. The work implement of claim 1 wherein the load rest includes a middle portion and a side portion and the gate is in the middle portion.

7. The work implement of claim 1 further comprising a biasing member for biasing the gate in the closed position.

8. The work implement of claim 1 further comprising one or more fork tines combined with the pallet fork frame.

9. A work implement comprising:

a frame adapted to be combined with a lift truck vehicle, wherein the frame has a top support aligned generally in a vertical plane with a bottom support;

a load rest combined with the top support of the frame;

wherein a portion of the load rest is a gate movable between an open position having a walkway through the load rest and a closed position where the gate functions as part of the load rest to help support the load;

wherein the bottom support of the frame does not include a gate.

10. The work implement of claim 9 wherein the gate is pivotally combined with the load rest.

11. The work implement of claim 9 wherein the gate is pivotally combined with the frame.

12. The work implement of claim 9 wherein the gate is slidably combined with the load rest.

13. The work implement of claim 9 wherein the gate is slidably combined with the frame.

14. The work implement of claim 9 wherein the frame further comprises a step positioned beneath the gate.

15. The work implement of claim 9 further comprising one or more fork tines combined with the frame.

16. A work implement comprising:

a frame having a width;

a load rest combined with the frame and extending across the width of the frame in a first plane, wherein the load rest includes a middle portion adjacent to a side portion;

wherein the middle portion of the load rest is a gate movable between an open position and a closed position, wherein in the open position the gate provides a walkway through the load rest and in the closed position the gate functions as part of the load rest to help support the load;

wherein the middle portion of the load rest and the side portion of the load rest are positioned in the first plane when the gate is in the closed position.

17. The work implement of claim 16 wherein the gate is pivotally combined with the load rest.

18. The work implement of claim 16 wherein the gate is pivotally combined with the frame.

19. The work implement of claim 16 wherein the gate is slidably combined with the load rest.

20. The work implement of claim 16 wherein the gate is slidably combined with the frame.

21. The work implement of claim 16 further comprising a step combined with the frame beneath the gate.

* * * * *